US008528478B2

(12) United States Patent
Fisher

(10) Patent No.: US 8,528,478 B2
(45) Date of Patent: Sep. 10, 2013

(54) SAFE ARMING SYSTEM AND METHOD

(75) Inventor: Delmer D. Fisher, Indianapolis, IN (US)

(73) Assignee: Raytheon Company, Waltham, MA (US)

( * ) Notice: Subject to any disclaimer, the term of this patent is extended or adjusted under 35 U.S.C. 154(b) by 222 days.

(21) Appl. No.: 12/874,922

(22) Filed: Sep. 2, 2010

(65) Prior Publication Data

US 2012/0118190 A1 May 17, 2012

Related U.S. Application Data

(60) Provisional application No. 61/240,072, filed on Sep. 4, 2009.

(51) Int. Cl.
*F23Q 7/24* (2006.01)
*F42C 15/40* (2006.01)

(52) U.S. Cl.
USPC ..... 102/215; 102/262

(58) Field of Classification Search
USPC ..... 102/215, 221, 262, 265
See application file for complete search history.

(56) References Cited

U.S. PATENT DOCUMENTS

| | | | | |
|---|---|---|---|---|
| 3,967,554 | A | 7/1976 | Troyer, Jr. | 102/70.2 R |
| 3,994,231 | A | 11/1976 | Rudeen et al. | 102/81 |
| 4,013,012 | A | 3/1977 | Giattino | 102/70.2 |
| 4,215,635 | A | 8/1980 | Farace | 102/238 |
| 4,240,351 | A | 12/1980 | San Miguel | 102/262 |
| 4,341,159 | A | 7/1982 | Edminster | 102/228 |
| 4,478,127 | A | 10/1984 | Hennings et al. | 89/1.5 D |
| 4,478,147 | A | 10/1984 | Hennings et al. | 102/255 |
| 4,489,656 | A | 12/1984 | Hennings et al. | 102/254 |
| 4,635,552 | A | 1/1987 | Battle | 102/254 |
| 4,679,751 | A | 7/1987 | Peterson | 244/137.4 |
| 4,899,659 | A | 2/1990 | Hardt | 102/229 |
| 5,063,846 | A | 11/1991 | Willis et al. | 102/215 |
| 5,245,926 | A | 9/1993 | Hunter | 102/215 |
| 5,265,539 | A | 11/1993 | Kurschner et al. | 102/206 |
| 5,271,327 | A | 12/1993 | Filo et al. | 102/207 |
| 5,275,107 | A | 1/1994 | Weber et al. | 102/251 |
| 5,460,093 | A * | 10/1995 | Prinz et al. | 102/217 |
| 5,594,195 | A | 1/1997 | Lenko et al. | 102/260 |
| 6,050,195 | A | 4/2000 | Diorio | |
| 6,196,130 | B1 | 3/2001 | Crist et al. | 102/221 |

(Continued)

FOREIGN PATENT DOCUMENTS

| | | |
|---|---|---|
| EP | 0 433 697 A2 | 6/1991 |
| WO | WO 00/55564 | 9/2000 |

OTHER PUBLICATIONS

PCT Notification of Transmittal of the International Search Report and the Written Opinion of the International Searching Authority, or the Declaration, mailed Dec. 27, 2010 with regard to PCT/US2010/047848 filed Sep. 3, 2010, Dec. 27, 2010.

*Primary Examiner* — Bret Hayes
(74) *Attorney, Agent, or Firm* — Renner, Otto, Boisselle & Sklar, LLP

(57) ABSTRACT

According to certain embodiments, an arming system includes a first logic device and a second logic device that are both coupled to a detonation circuit operable to initiate a detonation device. The second logic device is operable to receive one or more first signals generated by the first logic device, determine a first fault condition of the first logic device according to the received one or more first signals, and disable the detonation circuit according to the determined first fault condition.

33 Claims, 5 Drawing Sheets

(56) References Cited

U.S. PATENT DOCUMENTS

| | | | | |
|---|---|---|---|---|
| 6,272,995 | B1 | 8/2001 | Schmidt et al. | 102/209 |
| 6,295,932 | B1 | 10/2001 | Kane, III | 102/221 |
| 6,460,445 | B1 | 10/2002 | Young et al. | 89/1.51 |
| 6,860,206 | B1 | 3/2005 | Rudakevych et al. | |
| 6,966,261 | B2 | 11/2005 | Keil | 102/202.3 |
| 7,124,689 | B2 | 10/2006 | Davis et al. | 102/216 |
| 7,261,035 | B1 | 8/2007 | Munsinger | 102/200 |
| 7,331,290 | B1 | 2/2008 | Keil | 102/202.3 |
| 7,343,860 | B2 | 3/2008 | Michel et al. | 102/275 |
| 7,591,225 | B1 | 9/2009 | Cope et al. | 102/221 |
| 7,614,346 | B2 | 11/2009 | Kienzler et al. | 102/222 |
| 7,654,186 | B1 | 2/2010 | Cope et al. | 89/6.5 |
| 7,699,003 | B2 | 4/2010 | Zinell et al. | 102/221 |
| 7,958,825 | B2 | 6/2011 | Lee et al. | 102/377 |
| 7,980,179 | B2 | 7/2011 | Harbrecht et al. | 102/222 |
| 8,042,471 | B2 | 10/2011 | Michel et al. | 102/275 |
| 2004/0231547 | A1 | 11/2004 | Keil | 102/206 |
| 2006/0107862 | A1 | 5/2006 | Davis et al. | 102/216 |
| 2007/0204757 | A1* | 9/2007 | Teowee et al. | 102/252 |
| 2008/0011179 | A1 | 1/2008 | Michel et al. | 102/275 |
| 2008/0210116 | A1 | 9/2008 | Zinell et al. | 102/221 |
| 2009/0078145 | A1 | 3/2009 | Lee et al. | 102/377 |
| 2009/0151585 | A1 | 6/2009 | Harbrecht et al. | 102/222 |
| 2010/0031841 | A1 | 2/2010 | Michel et al. | 102/222 |
| 2010/0213306 | A1* | 8/2010 | Olden et al. | 244/3.15 |
| 2011/0056401 | A1 | 3/2011 | Aliaghai et al. | 102/251 |

* cited by examiner

STORAGE
BATTERY TEST
CONNECT TO TRANSMITTER
SELF-TEST
BIT FAILED
SAFE
DE-PROGRAM
PROGRAMMING ERROR
PROGRAM AND VERIFY
STANDBY
DISARM COMMAND
TEST CMD.
REMOVE PIN
REPLACE PIN
TEST
ARM DELAY
TEST CMD.
REPLACE PIN
ARMED
FIRE CMD.
FIRE
4 SEC.
DUD

SAFE ARMING SYSTEM AND METHOD

RELATED APPLICATIONS

This application claims the benefit under 35 U.S.C. §119 (e) of the priority of U.S. Provisional Patent Application Ser. No. 61/240,072, entitled "Safe Arming System," filed Sep. 4, 2009, the entire disclosure of which is hereby incorporated by reference.

TECHNICAL FIELD OF THE DISCLOSURE

This disclosure generally relates to detonation devices, and more particularly, to a safe arming system and method.

BACKGROUND

Explosives used in military combat may be initiated by detonation devices. Some detonation devices convert signals into mechanical energy for initiating the primary charge of an explosive. Examples of detonation devices may include blasting caps, exploding foil initiators (EFIs) that convert electrical signals into mechanical energy, and shock tubes that convert pneumatic pressure pulses into mechanical energy.

SUMMARY

According to certain embodiments, an arming system includes a first logic device and a second logic device that are both coupled to a detonation circuit operable to initiate a detonation device. The second logic device is operable to receive one or more first signals generated by the first logic device, determine a first fault condition of the first logic device according to the received one or more first signals, and disable the detonation circuit according to the determined first fault condition.

Certain embodiments of the disclosure may provide one or more technical advantages. For example, certain embodiments of the arming system may provide hardware or logic safety features to reduce or eliminate one or more single-point-of-failures that could lead to inadvertent activation of the detonation circuit and inadvertent firing of the detonation device. Additionally, firmware cross-checks may be conducted by a first logic device and a second logic device to ensure that hardware is functioning properly during the arming system's programming, arming, testing, and firing states of operation. In certain embodiments, if the first logic device or the second logic device detects a failure, the device disables by entering a 'dud' state to prevent firing.

Certain embodiments of the present disclosure may provide some, all, or none of these advantages. Certain embodiments may provide one or more other technical advantages, one or more of which may be readily apparent to those skilled in the art from the figures, descriptions, and claims included herein.

BRIEF DESCRIPTION OF THE DRAWINGS

To provide a more complete understanding of embodiments of the present disclosure and the features and advantages thereof, reference is made to the following description taken in conjunction with the accompanying drawings, in which.

DESCRIPTION OF EXAMPLE EMBODIMENTS

Figure 1A:
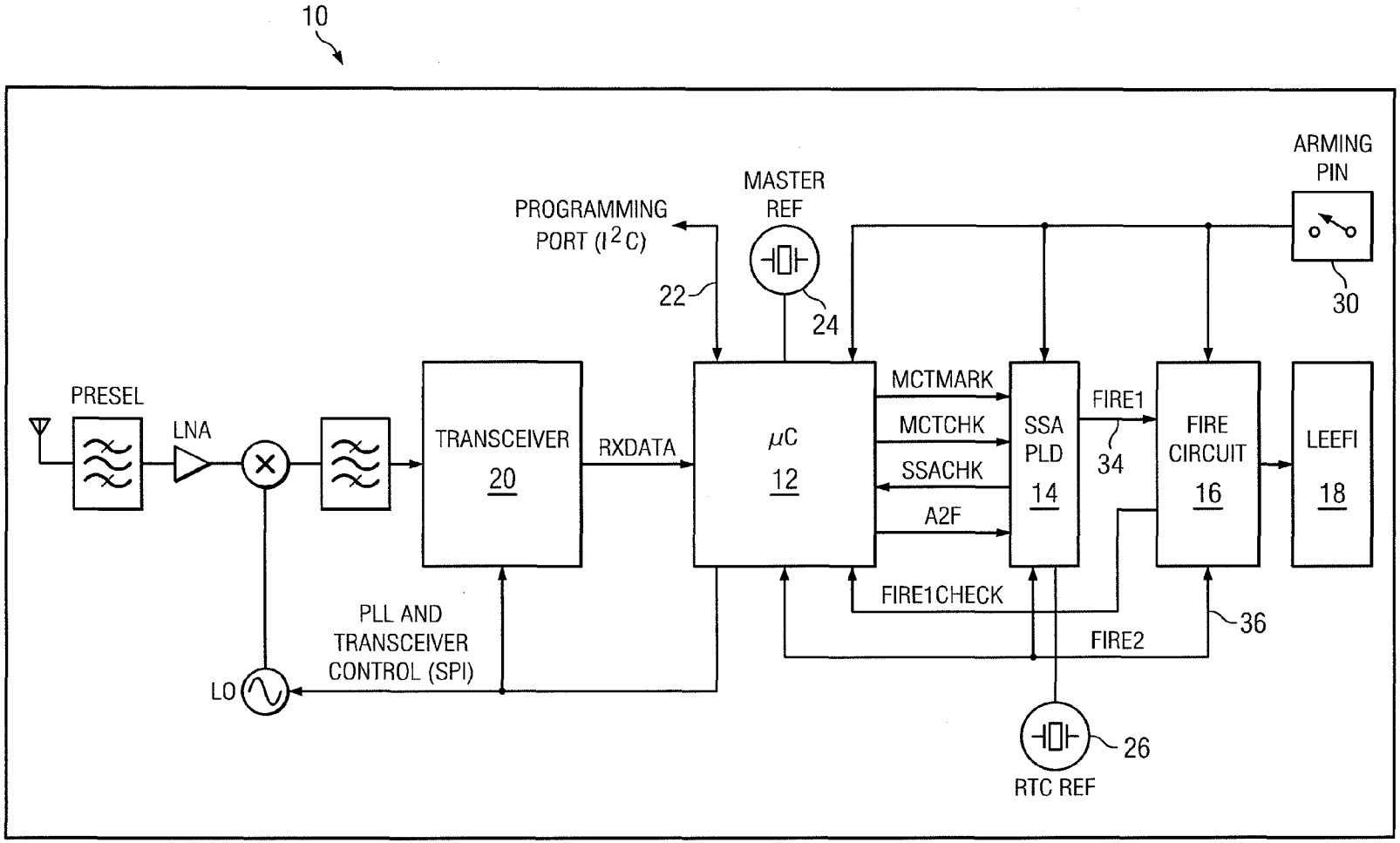
FIGS. 1A and 1B illustrate an example arming system according to certain embodiments of the present disclosure.
Figure 1B:
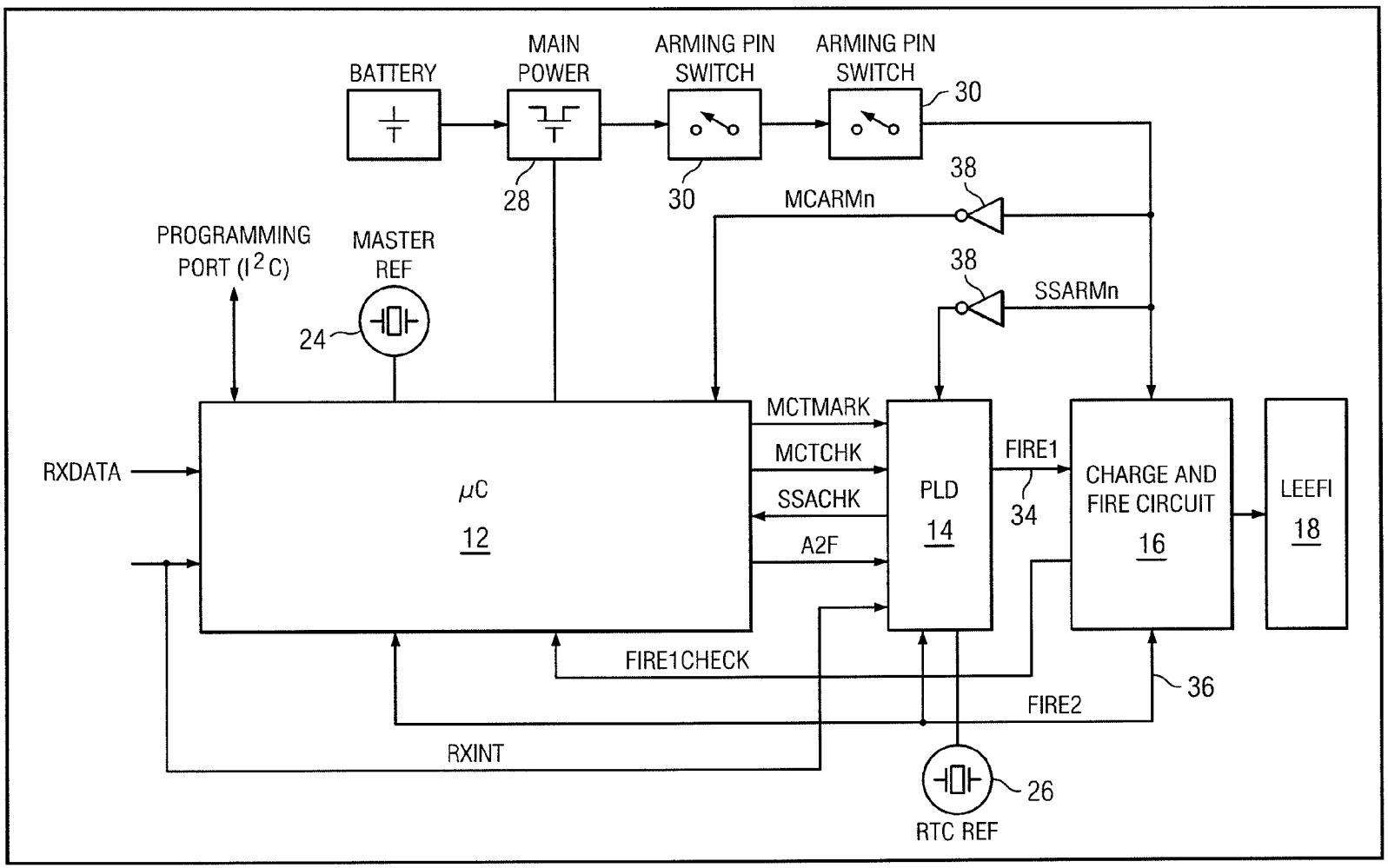

FIGS. 1A and 1B illustrate an example arming system 10 according to certain embodiments of the present disclosure. Arming system 10 includes a processor 12, a programmable logic device (PLD) 14, a detonation circuit 16, and a detonation device 18. Arming system 10 may also include a transceiver 20 for receiving detonation signals remotely using wireless radio-frequency (RF) signaling techniques. As will be described in detail below, processor 12 and programmable logic device 14 both include logic that validates proper operation of each other, and disables detonation circuit 16 if improper operation is detected. To this end, arming system 10 may employ one or a combination of hardware/firmware and logic features which provide multiple levels of system redundancy and crosschecking in order to safeguard against premature, spontaneous, "non-user initiated" and/or otherwise unintentional arming and/or firing of detonation device 18.

In the particular embodiment shown, detonation device 18 is a low energy exploding foil initiator (LEEFI). In other embodiments, detonation device 18 may be any type of device adapted to initiate detonation of a primary charge of an explosive.

Although the illustrated embodiment includes a processor 12 and a programmable logic device 14, other embodiments may be implemented using any two or more independently operating logic devices that monitor one another during their operation. For example, certain embodiments of arming system 10 may include two processors that monitor one another. As another example, certain embodiments of arming system 10 may include two programmable logic devices that monitor one another.

Processor 12 may include a programming port 22 and a clock 24. Programming port 22 may be used to receive instructions to be executed by processor 12 (e.g., from an external source). In this manner, an updated instruction set may be loaded into processor 12, following its manufacture for example.

Processor 12 may be implemented in any suitable combination of hardware, firmware, and software. Processor 12 includes one or more processors and one or more memory units. A processor as described herein may include one or more microprocessors, controllers, or any other suitable computing devices or resources and may work, either alone or with other components of arming system 10, to provide a portion or all of the functionality of arming system 10 described herein. A memory unit as described herein may take the form of volatile and/or non-volatile memory including, without limitation, magnetic media, optical media, random access memory (RAM), read-only memory (ROM), removable media, or any other suitable memory component. A portion or all of memory units may be remote from processor 12, if appropriate.

Programmable logic device 14 may be any electrical circuit that executes logic. In certain embodiments, programmable logic device 14 is an application specific integrated circuit (ASIC). In certain embodiments, programmable logic device 14 is a field programmable gate array (FPGA). Like processor 12, programmable logic device 14 may be coupled to a clock 26 that drives its operation. In certain embodiments, processor 12 and programmable logic device 14 each operate from independent clocks 24 and 26 to prevent a single fault in one clock 24 or 26 or the other clock 26 or 24 from causing an operating fault in either processor 12 or programmable logic device 14. In certain embodiments, arming system 10 may include a single clock 24 or 26 that drives operation of processor 12 and programmable logic device 14.

Numerous types of detonation devices have been developed for initiating explosives. Due to potential damage caused by the explosives, their detonation devices may be configured with various safety features for protection from premature detonation. For example, detonation devices may be configured with electrical circuitry designed to provide safety features. Nevertheless, the electrical circuitry may be prone to failure due to one or a combination of reasons, including operation outside acceptable thermal limits of electrical components of the electrical circuit, end-of-life failure of particular electrical components of the circuitry, and/or failure due to excessive mechanical shock imparted into the circuitry.

Certain embodiments of the disclosure may provide one or more technical advantages. For example, certain embodiments of arming system 10 may provide hardware or logic safety features to reduce or eliminate one or more single-point-of-failures that could lead to inadvertent activation of detonation circuit 16 and inadvertent firing of detonation device 18. Additionally, firmware cross-checks may be conducted by processor 12 functioning as a first logic device and programmable logic device 14 functioning as the second logic device to ensure that hardware is functioning properly during the arming system's programming, arming, testing, and firing states of operation. In certain embodiments, if the first logic device or the second logic device detects a failure, the device disables by entering a 'dud' state to prevent firing.

Arming system 10 may provide one or more safety features. In certain embodiments, battery power to processor 12, programmable logic device 14, and detonation circuit 16 is switched via a main power switch 28. When arming system 10 is in a 'storage' state (See FIG. 2), main power switch 28 is held in a powered off condition by processor 12. When arming system 10 is activated, such as by connecting arming system 10 to a suitable transmitter for programming, processor 12 may then turn on main power switch 28. When arming system 10 is powered up via main power switch 28, power may be provided to processor 12, programmable logic device 14, and detonation circuit 16. In certain embodiments, two arming pin switches 30 connected in series, however, may prevent power from reaching detonation circuit 16. Arming pin switches 30 are both normally open when an arming pin is in place and are actuated (e.g., closed) simultaneously when the arming pin is removed. Battery or "main" power may be provided to detonation circuit 16 when arming pin switches 30 are both closed. In certain embodiments, this redundant switch arrangement may help prevent unintentional arming of arming device 10 in the event of a single switch failure.

In certain embodiments, as arming device 10 is being programmed in a manner described above, processor 12 checks the state of arming pin switches 30 immediately upon activation of main power switch 28. Example operating states for arming system 10 are shown and described below with reference to FIG. 2. Processor 12 may conduct a self test of arming device 10 upon exiting the 'storage' state and before entering 'programming' state. If processor 12 detects that arming pin switches 30 are closed during the self-test (e.g., arming pin not present or faulty arming switches), processor 12 may enter the 'safe' state and disconnect battery power from arming device 10 via main power switch 28, returning the unit then to the 'storage' state (e.g., power off).

In certain embodiments, power may be further prevented from reaching detonation circuit 16 by an additional switch internal to detonation circuit 16. This charging power switch is controlled by a 'fire1' signal 34 generated by programmable logic device 14. Thus, detonation circuit 16 is powered on when 'fire1' signal 34 is driven active. In certain embodiments, the final signal to be activated in the firing sequence is a 'fire2' signal 36. As an example, this signal may be driven active by processor 12 after all other self-tests and safety checks have been passed and upon receipt of a fire command generated by transceiver 20. In certain embodiments, certain "sneak paths" between processor 12 and programmable logic device 14 may be reduced or eliminated by buffer stages 38, which may prevent a fault in processor 12 from indicating a false 'armed' state to programmable logic device 14, or vice versa.

Figure 2:
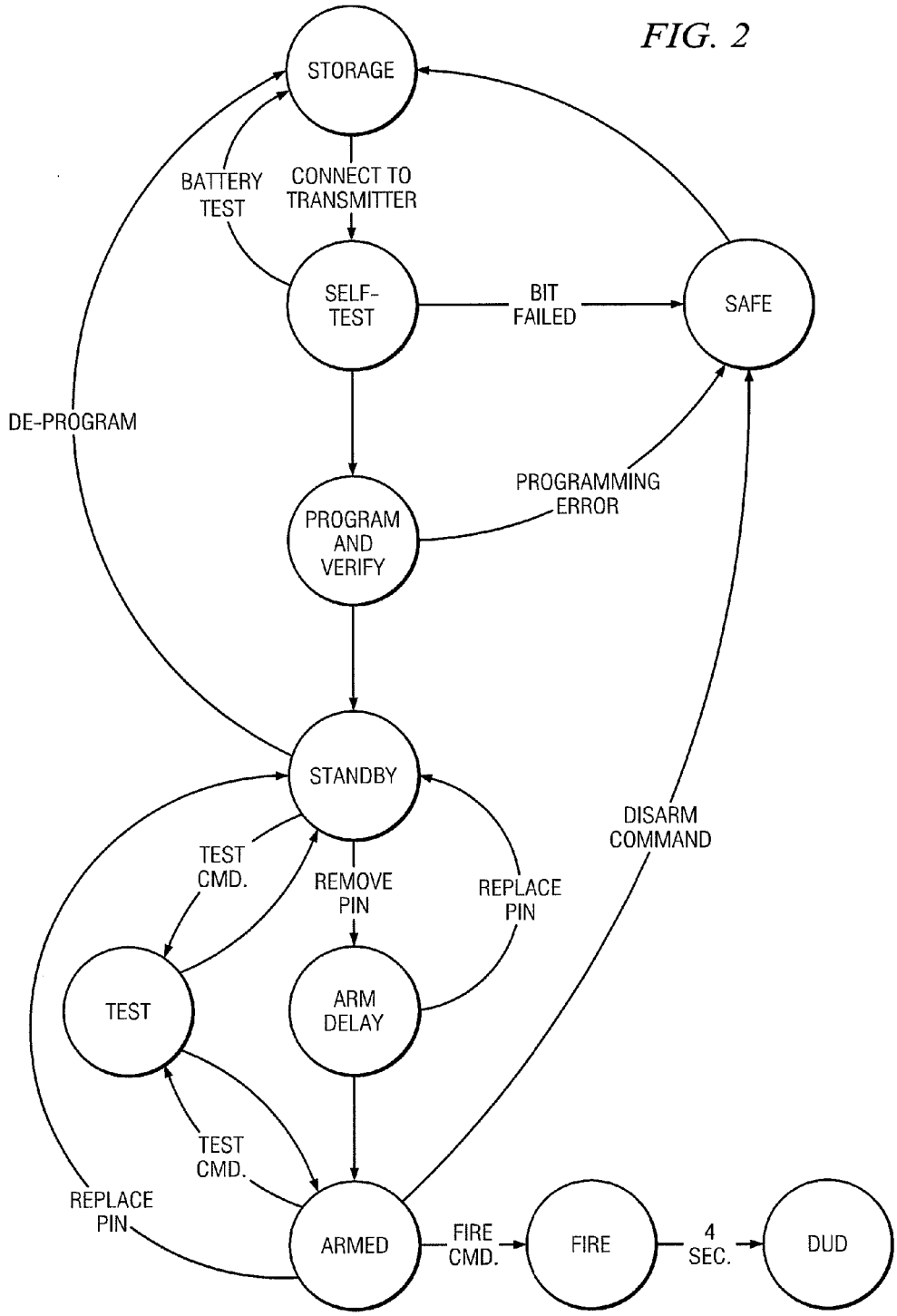
FIG. 2 illustrates an example state diagram showing various example states of the arming system of FIG. 1.

FIG. 2 illustrates an example state diagram showing various example states of arming system 10 of FIG. 1. In this example, valid states may include a storage state, a self-test state, a 'safe' state, a 'program and verify' state, a 'standby' state, an 'arm delay' state, a 'test' state, an 'armed' state, a 'fire' state, and a 'dud' state.

The 'storage' state generally describes a condition in which arming system 10 is in a powered down state. The 'self test' state generally describes a state that arming system 10 may exist in while internal tests are conducted on its various elements. The 'program and verify' state generally describes a state that arming system 10 may exist in while processor 12 and/or programmable logic device (PLD) 14 are being programmed. The 'standby' state generally describes a condition in which arming system 10 has been programmed and is prepared for arming. The 'arm delay' state generally describes a state that arming system 10 may exist in while a delay is being programmed by a user. The 'armed' state generally describes a state in which arming system 10 is prepared for activation of detonation device 18. The 'fire' state generally describes a condition in which arming system 10 activate detonation device 18. The 'dud' and 'safe' states generally describe a condition of arming system 10 in which detonation circuit 16 is inhibited from detonating.

Figure 3:
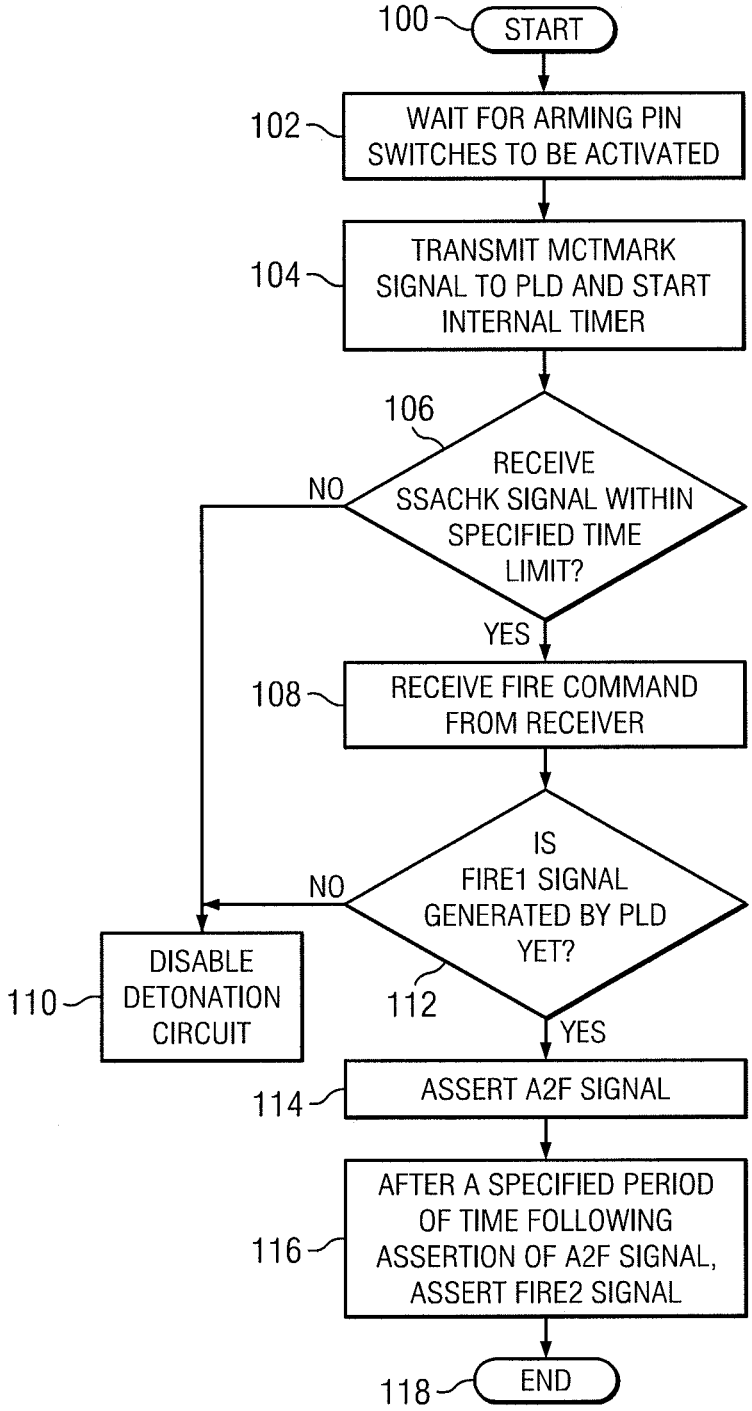
FIG. 3 illustrates an example process for activating the detonation circuit according to certain embodiments of the present disclosure.

FIG. 3 illustrates an example process for activating detonation circuit 16 according to certain embodiments of the present disclosure. In act 100, the process is initiated.

In act 102, processor 12 waits for activation of arming pin switches 30. In the particular embodiment shown, two arming pin switches 30 are coupled in series such that a fault of any one arming pin switch 30 does not erroneously generate a signal to move arming system from the 'standby' state to the 'armed' state. In certain other embodiments, only one arming pin switch 30 or more than two arming pin switches 30 may be implemented.

In act 104, processor 12 powers up, initializes itself, and generates a 'mctmark' signal in response to activation of arming pin switches 30 The 'mctmark' signal is transmitted to programmable logic device 14 and starts its internal timer. As will be described below with reference to FIG. 4, receipt of 'mctmark' signal by programmable logic device 14 may cause programmable logic device 14 to start its timer which may be set a value similar to that of the timer internal to processor 12. The elapsed time values of timers generally describes the amount of time that arming system 10 remains in the 'arm delay' state and may be any suitable value. In certain embodiments, the elapsed time value may be 4 seconds, an elapsed time value that may provide an adequate delay for arming system 10 while in the 'arm delay' state.

In act 106, processor 12 verifies that timer completed signal 'ssachk' is generated by timer 26 within the specified time limit as described with reference to act 104. In certain embodiments, processor 12 may include a tolerance window of approximately +/−0.01 seconds in which timer completed signal 'ssachk' is received from programmable logic device 14. Thus, if timer completed signal 'ssachk' is received from programmable logic device 14 at the specified time in addition to the tolerance window, processing continues at act 108; otherwise processor 12 forces arming system 10 to the 'dud' state in which activation of detonation circuit 16 is disabled.

In act 108, processor 12 receives a fire command signal from receiver 20 at an elapsed period of time following the action performed in act 106. During this elapsed period of time, processor 12 may perform any suitable self-tests and/or may disarm arming system 10 in which it reverts to the 'storage' state. In the particular embodiment, the fire command signal is wirelessly received from a remote transmitter. In certain embodiments, the fire command signal may be received in any suitable manner. For example, the fire command signal may be received from a wired communication link, such as an elongated section of wire cabling for actuating the fire command signal at a safe distance. As another example, the fire command signal may be received from a timer circuit that generates the fire command signal after a specified period of elapsed time.

In act 110, processor 12 verifies that programmable logic device 14 has not yet asserted the 'fire1' signal to detonation circuit 16. To this end, processor 12 may receive 'fire1chk' signal from detonation circuit 16 in which 'fire1chk' signal represents the 'fire1' signal received from programmable logic device 14. In other words, detonation circuit 16 forms a 'loopback' configuration in which the 'fire1' signal received from programmable logic device 14 is looped back to form 'fire1chk' signal. In this manner, the logic value of the 'fire1' signal perceived by detonation circuit 16 may be checked to verify proper operation of programmable logic device 14 and associated circuit traces extending between programmable logic device 14 and detonation circuit 16.

If 'fire1chk' signal is not yet asserted, processing continues at act 114, otherwise processor 12 forces arming system 10 to the 'safe' state in which activation of detonation circuit 16 is inhibited.

In act 114, processor 12 asserts the 'A2F' signal that is transmitted to programmable logic device 14. The purpose of the 'A2F' signal will be described in greater detail below.

In act 116, processor 12 asserts the 'fire2' signal at a specified period of time following assertion of the 'A2F' signal. By assertion of the 'fire2' signal, processor 12 has deemed that that signals generated by programmable logic device 14 have been received in the proper order and thus programmable logic device 14 is operating properly. The 'fire2' signal is generated by processor 12 to activate detonation circuit 16. Detonation circuit 16, however, also requires generation of the 'fire1' signal by programmable logic device 14 to activate detonation device 18.

Figure 4:
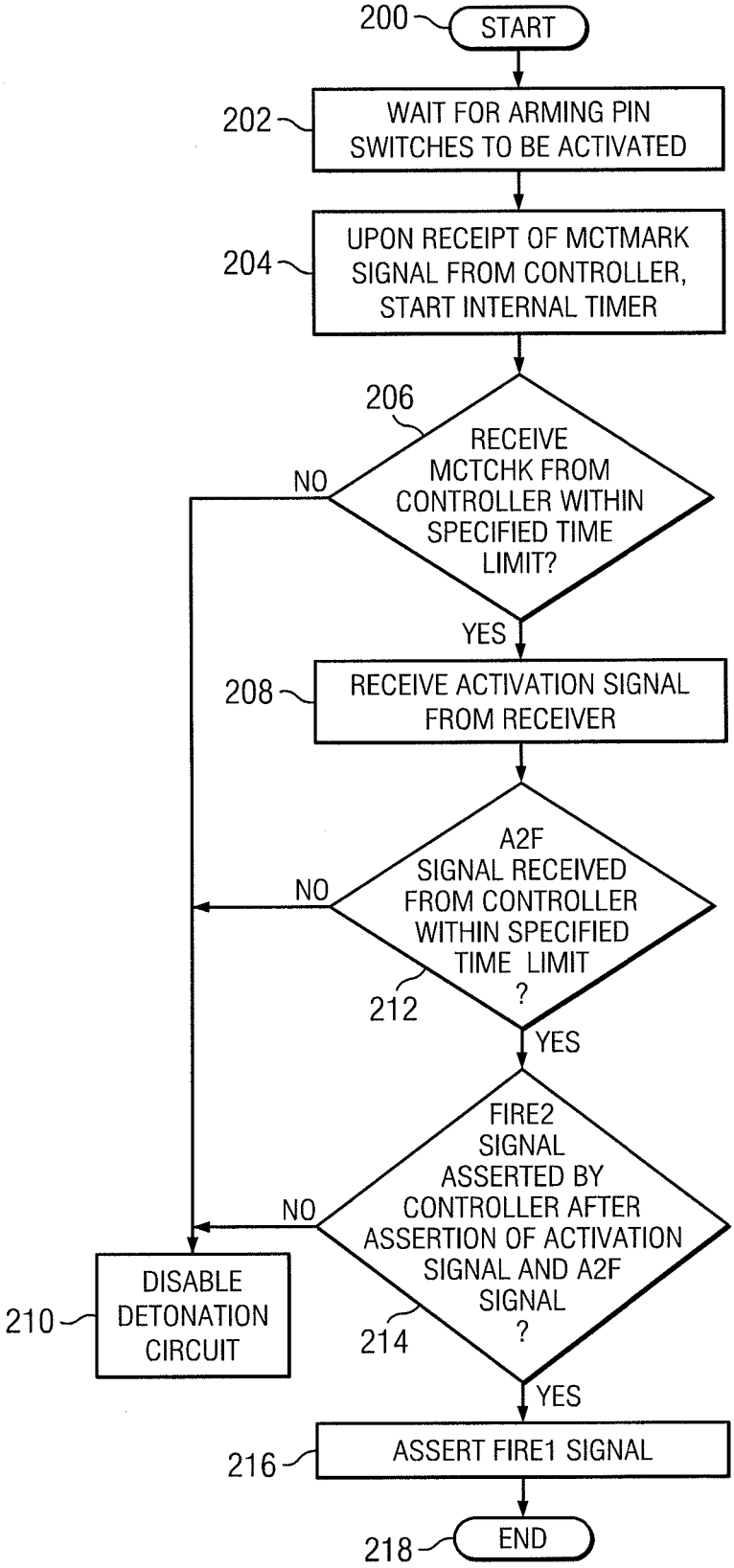
FIG. 4 illustrates another example process for activating the detonation circuit according to certain embodiments of the present disclosure.

FIG. 4 illustrates another example process for activating detonation circuit 16 according to certain embodiments of the present disclosure. The actions described below may occur concurrently with the actions performed by processor 12 described above. In act 200, the process is initiated.

In act 202, programmable logic device 14 waits for activation of arming pin switches 30 and may also clear any signals that have been previously asserted. Because activation of detonation circuit 16 requires assertion of the 'fire1' signal generated by programmable logic device and 'fire2' signal generated by processor 12, programmable logic device 14 and processor 12 form a redundant arming scheme in which improper receipt of arming signal from arming pin switches 30 by either programmable logic device 14 or processor 12 may be reduced or eliminated.

In act 204, programmable logic device 14 starts its timer 26 upon receipt of the 'mctmark' signal from processor 12. As described above, timer 26 may have an elapsed time value similar to that of the timer internal to processor 12. When the timer internal to programmable logic device 14 completes, programmable logic device 14 generates 'ssachk' signal that is transmitted to processor 12.

In act 206, programmable logic device 14 verifies that timer completed signal 'mctchk' is generated by the timer internal to programmable logic device 14 within the specified time limit as described with reference to act 104. If timer completed the 'mctchk' signal is received from processor 12 at the specified time in addition to the tolerance window, processing continues at act 208; otherwise processing ends in act 210 in which programmable logic device 14 forces arming system 10 to the 'dud' state and activation of detonation circuit 16 is inhibited.

In act 208, programmable logic device 14 receives the fire command signal from receiver 20. The fire command signal is same fire command signal that is received by processor 12 in act 108.

In act 212, programmable logic device 14 verifies that processor 12 generates the 'A2F' signal within a specified period of time following receipt of fire command signal from receiver 20. Among other redundant features provided, this particular sequence may be useful for verifying that both processor 12 and programmable logic device 14 receive and accept as valid the fire command signal from receiver 20. If the 'A2F' signal is received from processor 12 at the specified time, processing continues at act 214; otherwise processing ends in act 210 in which programmable logic device 14 forces arming system 10 to the 'dud' state and activation of detonation circuit 16 is inhibited.

In act 214, programmable logic device 14 verifies that the 'fire2' signal is generated by processor 12 after fire command signal generated by receiver 20, and the 'A2F' signal generated by processor 12. That is, programmable logic device 14 verifies that the 'fire2' signal is inactive prior to assertion of the fire command signal and the 'A2F' signal. In this manner, programmable logic device 14 may provide a cross-checking procedure of processor 12 to verify that processor 12 asserts the 'fire2' signal in the proper sequence. If the 'fire2' signal is received from processor 12 at the specified time, processing continues at act 216; otherwise processing ends in act 210 in which programmable logic device 14 forces arming system 10 to a 'safe' state and activation of detonation circuit 16 is inhibited.

In act 216, programmable logic device 14 asserts the 'fire1' signal to activate detonation circuit 16. If processor also asserts the 'fire2' signal, detonation circuit 16 is activated to detonate detonation device 18.

In act 218, the detonation device 18 has been activated and the process ends.

The foregoing embodiment describes concurrent processes performed by processor 12 and programmable logic device 14, which merely describe a particular embodiment in which multiple signals may be generated by each for monitoring by the other. In certain embodiments, any suitable sequence and type of signaling may be implemented such that processor 12 and programmable logic device 14 may verify each other's operation. Additionally, the foregoing embodiment describes a processor 12 that executes instruction stored in a memory operating in conjunction with a programmable logic device 14. In certain embodiments, two processors each executing instructions stored in a memory may be implemented, or two independently operating logic devices may be implemented.

Modifications, additions, or omissions may be made to arming system 10 without departing from the scope of the disclosure. The components of arming system 10 may be integrated or separated, or the operations of arming system 10 may be performed by more, fewer, or other components. For example, arming system 10 may include additional logic devices, such as processors or programmable logic devices such that three or more logic circuits may be implemented to verify proper operation of each another. Additionally, operations of processor 12 and/or programmable logic device 14 may be performed using any suitable logic comprising software, hardware, and/or other logic. As used in this document, "each" refers to each member of a set or each member of a subset of a set.

Although the present disclosure has been described with several embodiments, a myriad of changes, variations, alterations, transformations, and modifications may be suggested to one skilled in the art, and it is intended that the present disclosure encompass such changes, variations, alterations, transformation, and modifications as they fall within the scope of the appended claims.

What is claimed is:

1. An arming system comprising:

a first logic device coupled to a detonation circuit that, in operation of the arming system, selectively initiates a detonation device; and a second logic device coupled to the detonation circuit and the first logic device;

wherein, in operation of the arming system, the second logic device receives one or more first signals generated by the first logic device; determines a first fault condition of the first logic device according to the received one or more first signals; and disables the detonation circuit according to the determined first fault condition.

2. The arming system of claim 1, wherein, in operation of the arming system, the first logic device: receives one or more second signals generated by the second logic device; determines a second fault condition of the second logic device according to the received one or more second signals; and disables disable the detonation circuit according to the determined second fault condition.

3. The arming system of claim 1, wherein the first logic device comprises a memory coupled to a processor that executes instructions stored in the memory, and the second logic device comprises a programmable logic device.

4. The arming system of claim 1, wherein the first logic device and the second logic device each comprise a memory coupled to a processor that executes instructions stored in the memory.

5. The arming system of claim 1, wherein the first logic device and the second logic device each comprises a programmable logic device.

6. The arming system of claim 1, wherein, in operation of the arming system, the second logic device determines the fault condition based on not receiving the one or more first signals within a specified period of time.

7. The arming system of claim 1, further comprising a receiver circuit coupled to the first logic device and the second logic device;

wherein, in operation of the arming system, the first logic device and the second logic device inhibit the detonation circuit upon receiving a wireless signal from the receiver circuit.

8. The arming system of claim 1, further comprising at least two arming pin switches coupled to the first logic device and the second logic device;

wherein, in operation of the arming system, the first logic device and the second logic device inhibit the detonation circuit based on a failure of either of the at least two arming pin switches.

9. The arming system of claim 1, wherein the first logic device comprises a first clock and the second logic device comprises a second clock that operates independently of the first clock.

10. An arming method comprising:

receiving, by a second logic device, one or more first signals generated by a first logic device operable to initiate a detonation device;

determining, by the second logic device, a first fault condition of the first logic device according to the received one or more first signals; and disabling, by the second logic device, the detonation circuit according to the determined first fault condition.

11. The arming method of claim 10, further comprising:

receiving, by the first logic device, one or more second signals generated by the second logic device;

determining, by the first logic device, a second fault condition of the second logic device according to the received one or more second signals; and disabling, by the first logic device, the detonation circuit according to the determined second fault condition.

12. The arming method of claim 10, wherein the first logic device comprises a memory coupled to a processor that executes instructions stored in the memory, and the second logic device comprises a programmable logic device.

13. The arming method of claim 10, wherein the first logic device and the second logic device each comprise a memory coupled to a processor that executes instructions stored in the memory.

14. The arming method of claim 10, wherein the first logic device and the second logic device each comprises a programmable logic device.

15. The arming method of claim 10, wherein determining the first fault condition by the second logic device comprises determining the first fault condition based on not receiving the one or more first signals with a specified period of time.

16. The arming method of claim 10, further comprising inhibiting, by the first logic device and the second logic device, the detonation circuit according to a wireless signal received from a receiver circuit.

17. The arming method of claim 10, further comprising inhibiting, by the first logic device and the second logic device, the detonation circuit based on a failure of either of at least two arming pin switches.

18. The arming method of claim 10, further comprising: clocking the first logic device using a first clock; and clocking the second logic device using a second clock that operates independently of the first clock.

19. An arming system comprising:

a detonation circuit configured to initiate a detonation device; a first logic device coupled to the detonation circuit and operable to initiate the detonation device; and a second logic device coupled to the detonation circuit and the first logic device, the second logic device operable to:

receive one or more first signals generated by the first logic device;

determine a first fault condition of the first logic device according to the received one or more first signals; and disable the detonation circuit according to the determined first fault condition.

20. The arming system of claim 19, wherein the first logic device is operable to:

receive one or more second signals generated by the second logic device;

determine a second fault condition of the second logic device according to the received one or more second signals; and disable the detonation circuit according to the determined second fault condition.

21. The arming system of claim 19, wherein the first logic device comprises a memory coupled to a processor that executes instructions stored in the memory, and the second logic device comprises a programmable logic device.

22. The arming system of claim 19, wherein the first logic device and the second logic device each comprise a memory coupled to a processor that executes instructions stored in the memory.

23. The arming system of claim 19, wherein the first logic device and the second logic device each comprises a programmable logic device.

24. The arming system of claim 19, wherein the second logic device is operable to determine the fault condition based on not receiving the one or more first signals with a specified period of time.

25. The arming system of claim 19, further comprising a receiver circuit coupled to the first logic device and the second logic device, the first logic device and the second logic device operable to inhibit the detonation circuit according to a wireless signal received from the receiver circuit.

26. The arming system of claim 19, further comprising at least two arming pin switches coupled to the first logic device and the second logic device, the first logic device and the second logic device operable to inhibit the detonation circuit based on a failure of either of the at least two arming pin switches.

27. The arming system of claim 19, wherein the first logic device comprises a first clock and the second logic device comprises a second clock that operates independently of the first clock.

28. An arming system comprising:

a first logic device; and a second logic device;

wherein the first logic device is operably coupled to the second logic device to generate one or more first signals that are received by the second logic device; and wherein the second logic device selectively enables or disables a detonation circuit according to a first fault condition of the first logic device, which is determined in the second logic device from the one or more first signals.

29. The arming system of claim 28, wherein the second logic device is operable to generate one or more second signals that are received by the first logic device; and the first logic device selectively enables or disables a detonation circuit according to a first fault condition of the second logic device.

30. The arming system of claim 28, wherein the second logic device is operable to generate one or more third signals that are received by the detonation circuit to selectively enable or disable the detonation circuit.

31. The arming system of claim 30, wherein the second logic device is operable to generate the one or more third signals in response to the received one or more first signals.

32. The arming system of claim 28, wherein the first logic device is operable to generate one or more fourth signals that are received by the detonation circuit to selectively enable or disable the detonation circuit.

33. The arming device of claim 32, wherein the first logic circuit is operable to generate the one or more fourth signals in response to one or more second signals generated by the second logic device.

* * * * *